United States Patent [19]

Daume et al.

[11] 4,402,705

[45] Sep. 6, 1983

[54] INCENDIARY COMPOSITION CONTAINING A GROUP IVB METALLIC FUEL

[75] Inventors: Eduard Daume, Richterswil; Jürg Sarbach, Jona, both of Switzerland

[73] Assignee: Werkzeugmaschinenfabrik Oerlikon-Bührle AG, Zurich, Switzerland

[21] Appl. No.: 310,588

[22] Filed: Oct. 13, 1981

[30] Foreign Application Priority Data

Oct. 31, 1980 [CH] Switzerland ..... 8116/80

[51] Int. Cl.[3] ..... C10L 5/00

[52] U.S. Cl. ..... 44/1 R; 149/19.91; 149/114; 149/7

[58] Field of Search ..... 149/19.91, 7, 114; 44/1 R

[56] References Cited

U.S. PATENT DOCUMENTS

| | | | |
|---|---|---|---|
| 2,939,779 | 6/1960 | Brock | 149/76 |
| 3,030,243 | 4/1962 | Hart | 149/42 |
| 3,032,451 | 5/1962 | Tomlinson | 44/1 R |
| 3,109,762 | 11/1963 | Betts | 149/42 |
| 3,396,060 | 8/1968 | Piccone | 149/42 |
| 3,565,706 | 2/1971 | Waite | 149/19 |
| 3,734,788 | 5/1973 | Kaufmann | 149/19 |
| 3,865,035 | 2/1975 | Munson et al. | 102/66 |
| 3,927,993 | 12/1975 | Griffin | 44/39 |
| 3,956,038 | 5/1976 | Duguet et al. | 149/7 |
| 3,998,676 | 12/1976 | Plauson et al. | 149/7 |
| 4,090,894 | 5/1978 | Reed et al. | 149/19.91 |
| 4,128,996 | 12/1978 | Garner et al. | 149/19.91 |

FOREIGN PATENT DOCUMENTS 2901517 6/1979 Fed. Rep. of Germany .

*Primary Examiner*—Edward A. Miller

*Attorney, Agent, or Firm*—Werner W. Kleeman

[57] ABSTRACT

The incendiary mass comprises a zirconium or titanium powder containing a mean grain size of 15–50 μm, to which there is added less than 2%-by-weight of an organic binder, in particular polyvinylacetate because small binder concentrations have a favorable effect upon the action or effect pattern of the combusting or burning metal particles, i.e. upon the combustion time and length of the flight trajectory.

1 Claim, No Drawings

INCENDIARY COMPOSITION CONTAINING A GROUP IVB METALLIC FUEL

BACKGROUND OF THE INVENTION

The present invention relates to a new and improved compressible or compactible incendiary composition or mass.

Generally speaking, the incendiary composition or mass of the present development is of the type containing a metallic fuel selected from Group IVB of the periodic table of the elements and an organic binder. The metals which are used are preferably titanium and zirconium. The binder which is preferably employed is polyvinylacetate.

This incendiary composition or mass, when used for splitern or fragmentation-incendiary ammunition, is preferably arranged in a projectile body or explosive head together with a brisant or high explosive. However, it also can be pressed into the hollow space of a projectile that does not contain any explosive, for instance armor-piercing projectiles without explosives.

Due to the detonating or mechanical fragmentation of the projectile or explosive head at or in the neighborhood of the target there are formed, apart from the spliterns, rapidly flying incendiary composition-particles which autonomously burn in the atmosphere. In this way there is realised a combustion effect which is pronounced in space and is markedly expansive as a function of time.

A heretofore known incendiary composition or mass of the aforementioned type has been disclosed in German Pat. No. 2,901,517 and contains an organic binder and a sponge metal, for instance formed of zirconium or hafnium. There is used as the binder polytetrafluoroethylene in a proportion of 2 to 15%-by-weight.

Heretofore known fragmentation combustion ammunition contains mixtures of high explosive or brisant explosives such as hexogen, octogen, trotyl and aluminum powder. The metal additives produce an increase in the blast effect and the prolongation of the flame combustion time from 1 ms to 15 ms. In this way there is enhanced the probability of ignition of combustible material at the target, for instance running out or leaking fuel.

SUMMARY OF THE INVENTION

It is a primary object of the present invention to provide an improved incendiary composition or mass containing a lower proportion of binder than used with heretofore known incendiary compositions.

It is a further significant object of the present invention to provide an improved incendiary composition or mass containing a metallic fuel selected from Group IVB of the periodic table of the elements, and which incendiary composition is extremely effective in its action, particularly providing a more intense incendiary action and producing a greater amount of heat than prior art incendiary compositions.

DETAILED DESCRIPTION OF THE PREFERRED EMBODIMENTS

Describing now the invention in greater detail, at this point it is remarked that the use of fluorinated binders is supposed to augment the combustion by the formation of a tetrafluoride of the corresponding metal. In the case of metals in the form of coarse grain, porous sponge-like particles having a particle size of 0.05 to 8 μm there is strived for a prolongation in the combustion time. Tests have shown, that on the one hand, the use of a sponge metal is not absolutely necessary and, on the other hand, too much binder has an unfavorable effect upon the effect pattern or efficaciousness of the combustible metal particle, especially upon the combustion time and the distance or length of the trajectory.

Therefore, the invention contemplates employing the binder in the smallest possible concentration while still ensuring for an adequate compactability or compressability of the metal powder.

Therefore, according to the invention the proportion of binder in the incendiary composition is smaller than 2%-by-weight.

The binder can be admixed in conventional manner in the form of a binder solution with the metal powder. By sieving and removing the solvent at elevated temperature there is produced a compactible granulate.

Furthermore, it has been found that halogen-containing binders do not effectively augment the combustion of the metal. This also can be derived from the volume and mass-specific reaction enthalpy.

Reaction of the metal powder with the atmospheric oxygen:

$$Zr+O_2 \rightarrow ZrO_2 - 12\ kJ/g\ Metal = 78\ kJ/cm^3\ Metal$$

Reaction of the metal particles with the Teflon binder:

$$nZr+(C_2F_4)_n \rightarrow nZrF_4+2\ nC-5.4\ kJ/g\ Mixture = 17.7\ kJ/cm^3\ Mixture$$

The formed metal fluorides are easily volatilizable and remove energy from the system during evaporization.

The organic binder employed according to the invention is therefore preferably free of halogen.

Additionally, it has been found that the sponge metal used for the fabrication of the incendiary masses can be replaced by metal powder of pyrotechnic quality without any appreciable loss in the combustion time. A major advantage resides in a pronounced reduction in the danger of explosion during the compaction of the incendiary composition with the explosive. The explosion danger is great when using relatively large, sponge-like particles having a hard fissured or crevassed surface.

Therefore, it is preferable to use metal powder having a mean grain size in the order of 15 to 50 μm.

If there is used a sponge metal it may preferably have a grain size up to 2000 82 m.

In order to test the effectiveness of the incendiary compositions projectiles or projectile bodies containing at one end 5 grams of pressed-in incendiary mass and 25 grams of a highly explosive or brisant explosive formed of hexogen and trinitrotoluene are statically detonated or exploded.

The projectile body is erected upright upon a fixed support or substrate. The charge is caused to detonate by an electrically triggered fuze system.

There were measured the trajectory distance and the combustion time of the outwardly propelled cone-like and upwardly expanding or spreading apart combusting metal particles.

A. The effect of the grain size and the grain shape upon the effect pattern of the incendiary mass is apparent from the following table.

Binder: 1%-by-weight Polyvinylacetate

| Metal | Mean grain size of the metal particles μm | Trajectory distance of the metal particles m | Combustion time of the metal particles s |
|---|---|---|---|
| Titanium powder | 20 | 50 | 5.0 |
| Titanium powder | 200 | 50 | 5.0 |
| Titanium sponge | 2000 | 50 | 5.5 |
| Zirconium powder | 15 | 15 | 2.0 |
| Zirconium sponge | 2000 | 25 | 2.5 |

B. The influence of the binder concentration upon the effect pattern of the incendiary mass will be apparent from the following table. There was used zirconium powder having a mean grain size of 15 μm and as the binder polyvinylacetate.

| Binder concentration % by weight | Trajectory distance of the metal particle meters | Combustion time of the metal particle seconds |
|---|---|---|
| 1 | 15 | 2.0 |
| 4 | 3 | 1.7 |
| 16 | 1 | <1.7 |

While there are described present preferred embodiments of the invention, it is to be distinctly understood that the invention is not limited thereof, but may be otherwise variously embodied and practiced within the scope of the following claims.

We claim:

1. A compressible incendiary composition essentially consisting of:

a metallic fuel selected from Group IVB of the periodic table of the elements;

polyvinyl acetate as an organic binder free of halogen;

said metallic fuel consisting of a metal powder having a mean grain size in the order of 15–20 μm; and the proportion of polyvinyl acetate being smaller than 2%-by-weight.

* * * * *